US007207075B2

(12) United States Patent
Peterson et al.

(10) Patent No.: US 7,207,075 B2
(45) Date of Patent: Apr. 24, 2007

(54) INTERCHANGEABLE GOOSENECK FAUCET

(75) Inventors: Graham H. Peterson, Wilmington, DE (US); Michael W. Boyer, Wilmington, DE (US)

(73) Assignee: Speakman Company, New Castle, DE (US)

( * ) Notice: Subject to any disclaimer, the term of this patent is extended or adjusted under 35 U.S.C. 154(b) by 925 days.

(21) Appl. No.: 10/300,334

(22) Filed: Nov. 20, 2002

(65) Prior Publication Data

US 2003/0093857 A1 May 22, 2003

Related U.S. Application Data

(60) Provisional application No. 60/331,848, filed on Nov. 20, 2001.

(51) Int. Cl.
*E03C 1/04* (2006.01)

(52) U.S. Cl. ..... 4/678; 285/368

(58) Field of Classification Search ..... 4/567, 4/568, 570, 678, 696; 137/801; 285/139.1, 285/139.2, 139.3, 142.1, 368, 412
See application file for complete search history.

(56) References Cited

U.S. PATENT DOCUMENTS 506,842 A * 10/1893 Burke ..... 285/142.1
1,126,386 A * 1/1915 Butts ..... 285/368 X
2,009,651 A * 7/1935 Conde et al. ..... 4/678 X
2,570,635 A * 10/1951 Beyer, Jr. ..... 137/801 X
3,720,428 A * 3/1973 Zastawny ..... 285/368
3,965,937 A 6/1976 Reber ..... 137/625.47
4,161,965 A * 7/1979 Merritt ..... 4/567 X
4,537,360 A 8/1985 Bock ..... 239/553.3
4,624,415 A * 11/1986 Hofstetter, Jr. ..... 137/801 X
4,884,596 A 12/1989 Byers et al. ..... 137/801
5,108,606 A 4/1992 Maglio ..... 210/418
5,165,121 A 11/1992 McTargett et al. ..... 4/678
5,199,118 A 4/1993 Cole et al. ..... 4/619
5,242,119 A 9/1993 Jariyasunant ..... 239/590.3
5,303,737 A * 4/1994 Koch ..... 137/801 X
D349,326 S 8/1994 Bollenbacher ..... D23/238
D382,042 S 8/1997 Bollenbacher ..... D23/238
5,868,163 A * 2/1999 McDonald ..... 137/180 X
5,893,387 A * 4/1999 Paterson et al. ..... 4/678 X
6,256,810 B1 7/2001 Baker ..... 4/678
6,273,138 B1 8/2001 Yoney ..... 137/801

* cited by examiner

*Primary Examiner*—Robert M. Fetsuga
(74) *Attorney, Agent, or Firm*—Connolly Bove Lodge & Hutz LLP

(57) ABSTRACT

A faucet spout assembly providing multiple spouts with different heights and curvature which are interchangeable within the same faucet. Laminar flow from the spout is achieved with a flow control device upstream of the spout outlet A check valve is optionally used in the inlet to the spout to promote greater flexibility in placement of the flow control device within the assembly.

7 Claims, 8 Drawing Sheets

INTERCHANGEABLE GOOSENECK FAUCET

CROSS-REFERENCE TO RELATED APPLICATION

This application claims the benefit of prior filed provisional application No. 60/331,848 filed Nov. 20, 2001 entitled Interchangeable Gooseneck Faucet.

TECHNICAL FIELD OF THE INVENTION

This invention relates generally to a faucet spout assembly and more particularly to a faucet assembly with interchangeable spouts which provide laminar, non-splashing water flow without any stream regulating attachment at the outlet of the spout

BACKGROUND OF THE INVENTION

Faucet spout assemblies are widely used in households, industry, scientific laboratories, hospitals, etc. It is desired in some settings that faucet spouts of different configurations be available for use with a single faucet fixture. This raises a problem of how to economically achieve interchangeability of spouts Others have approached this problem as follows. According to Baker U.S. Pat. No. 6,256,810 an easy connect and disconnect faucet spout assembly is disclosed which can be mounted and removed in a quick and easy manner with a minimum of tools or operations, and without disassembling the faucet spout assembly or the water supply lines. At the same time, a spout assembly, according to the Baker patent, is comprised of a number of parts, some of which have a complicated shape. Moreover, each spout must be equipped with a special spout-mounting plate so interchangeability of spouts is expensive and requires a large parts inventory.

Another approach to providing adjustable spouts of varying heights in a faucet is disclosed in U.S. Pat. No. 6,273,138. This patent describes a height adjustable spout with a spigot-clamping member that is used to sealingly locate the spout at the desired height on the faucet This apparatus, however, has the distinct disadvantage of having a clamp handle extending into the useable space over the basin. This would not be commercially acceptable because of poor aesthetics and the collection of mold and bacteria on the clamp.

Another problem with commonly used spout assemblies is the location of outlet devices used to soften the flow of water out of the spout They are typically located at the outlet of the spout. Examples of such devices are disclosed in U.S. Patent Nos. 4,884,596; 5,108,606; 5,165,121; 5,242,119. Such devices—aerators, flow regulators and stream straighteners which are sometimes collectively referred to as laminar flow devices—serve as a trap, and consequently collector, for various germs and dirt because of their location at the spout outlet This problem is particularly acute in hospitals and health care facilities which must be particularly wary of areas where viruses like staphylococcus can take hold At the same time, it is difficult to abandon such spout end attachments in most applications because most faucet users demand a soft, non-splashing flow of water from a faucet spout.

SUMMARY OF THE INVENTION

An object of the present invention is, therefore, a faucet spout assembly with easily interchangeable spouts.

Another object of the invention is to provide new methods of forming a laminar stream at the outlet of a spout while at the same time preventing accumulation of germs and dust around the apparatus providing the laminar flow Still another object of the invention is to provide faucet spout assembly constructed of a minimal amount of parts, wherein each of them is simple and easy to assemble.

Yet another object of this invention is to provide a flow restriction device in the faucet in a location that facilitates use of interchangeable spouts Still another object of the invention is to provide a sealing engagement of spout to faucet that provides an effective water-tight seal between these parts while accommodating slight dimensional variation among the spouts when positioned on the faucet.

These and other objects may be achieved in this invention by placing a flow restrictor or flow control device in the faucet body adjacent to or near the upstream end of the interchangeable spout. Alternatively, the flow control device can be located further upstream in the water flow, for example, in the inlet of the valve controlling flow through the spout One end of the water supply pipe of the faucet of this invention includes a spout receptacle at the point where it mates with the interchangeable spout A flange lies atop the receptacle. A mating flange on each interchangeable spout is designed to be removably connected to the flange on the receptacle, for example, by suitable bolts or other fasteners.

The spout receptacle and/or spout preferably contain at least two sealing means associated therewith to insure a water tight seal and accommodate dimensional differences among the interchangeable spouts. In one embodiment of the invention, a flat washer is arranged in the bottom of the spout receptacle. This washer is dimensioned so that its outside circumference snugly fits within the spout receptacle and its inside opening is slightly smaller than the outside diameter of the spout so that it snugly fits around the circumference of the spout The flat washer is dimensioned to be slightly thicker than the nominal distance between the bottom of the spout and the bottom of the spout receptacle when the spout is placed in the receptacle By fabricating this washer from resilient compressible material such as Santoprene or an ethylene—propylene, diene monomer (EPDM), dimensional differences in the manufacture of the interchangeable spouts can be accommodated. Thus, if the distance between the bottom of the flange on the spout and the top of the washer is slightly greater than designed, compression of the washer will accommodate that difference while guaranteeing an effective water tight seal.

The sealing of the spout within the spout receptacle is completed with an O-ring arranged in a grove around the upper/inner periphery of the spout receptacle. Alternatively, the o-ring may be arranged so that a grove need not be formed in the spout receptacle. In this configuration, the O-ring is compressed between the flanges on the spout and spout receptacle.

Other approaches to sealing the spout within the spout receptacle are also contemplated. More particularly, as more fully discussed below, it has been found advantageous to include a check valve in the upstream end of the interchangeable spout which fits into the spout receptacle A cylindrical check valve holder is sized to fit within that end of the spout The check valve holder is preferably cylindrical with a peripheral rim that is pressed into engagement with the flat washer at the bottom of the spout receptacle. This provides some additional sealing since the bottom surface of the check valve holder is greater, and flatter, than the bottom of the spout. This increased surface area in contact with the flat washer reduces the opportunity for leakage at this point (spout-flat washer interface) of the faucet spout assembly.

A flow control device is used in the faucet assembly to provide a smooth, laminar flow of water from the spout. Devices providing laminar flow are typically located at the outlet of the faucet spout. Such a location has the disadvantage of being a collector of germs and dirt This presents a health issue and hospitals and some health care facilities have prohibited use of such devices in faucet spouts for that reason. Surprisingly, applicant(s) have found that placement of a flow restrictor or flow control device upstream of the spout outlet provides laminar flow at the outlet when the spout has a goose-neck shape Replacing a spout in the faucet of this invention is a simple operation of releasing bolts, or any affixing element, from the mating flanges on the faucet and spout. To place a new spout into the faucet, it is enough to insert the inlet end thereof into the spout receptacle and reattach the bolts or other affixing element joining the flanges of the spout and spout receptacle. These are tightened until the spout is sealed in the spout receptacle.

Further details of the present invention will become apparent from the detailed description given hereinafter. However, it should be understood that the detailed description and specific drawings, while indicating preferred embodiments of the invention, are given by way of illustration only, since various changes and modifications within the spirit and scope of the invention will become apparent to those skilled in the art from this detailed description It is to be understood that both the foregoing general description and the following detailed description are exemplary and explanatory only and are not restrictive of the invention, as claimed.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF PREFERRED EMBODIMENTS

With reference to the accompanying drawings, the readily interchangeable faucet spout assembly according to the present invention will be described.

Figure 1:
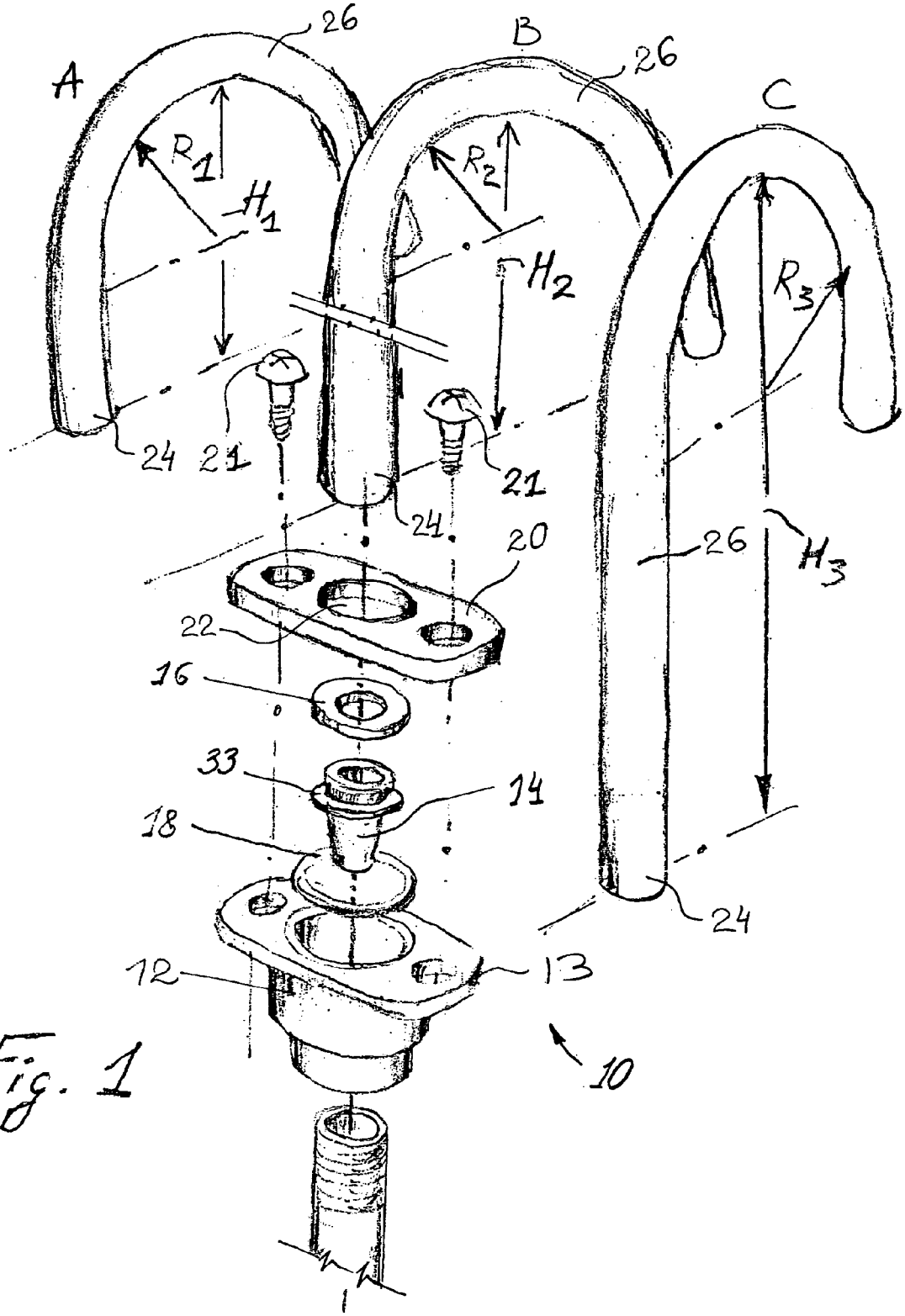
FIG. 1 is a perspective view of multiple spouts interchangeably useable in the faucet assembly according to the invention.
Figure 5:
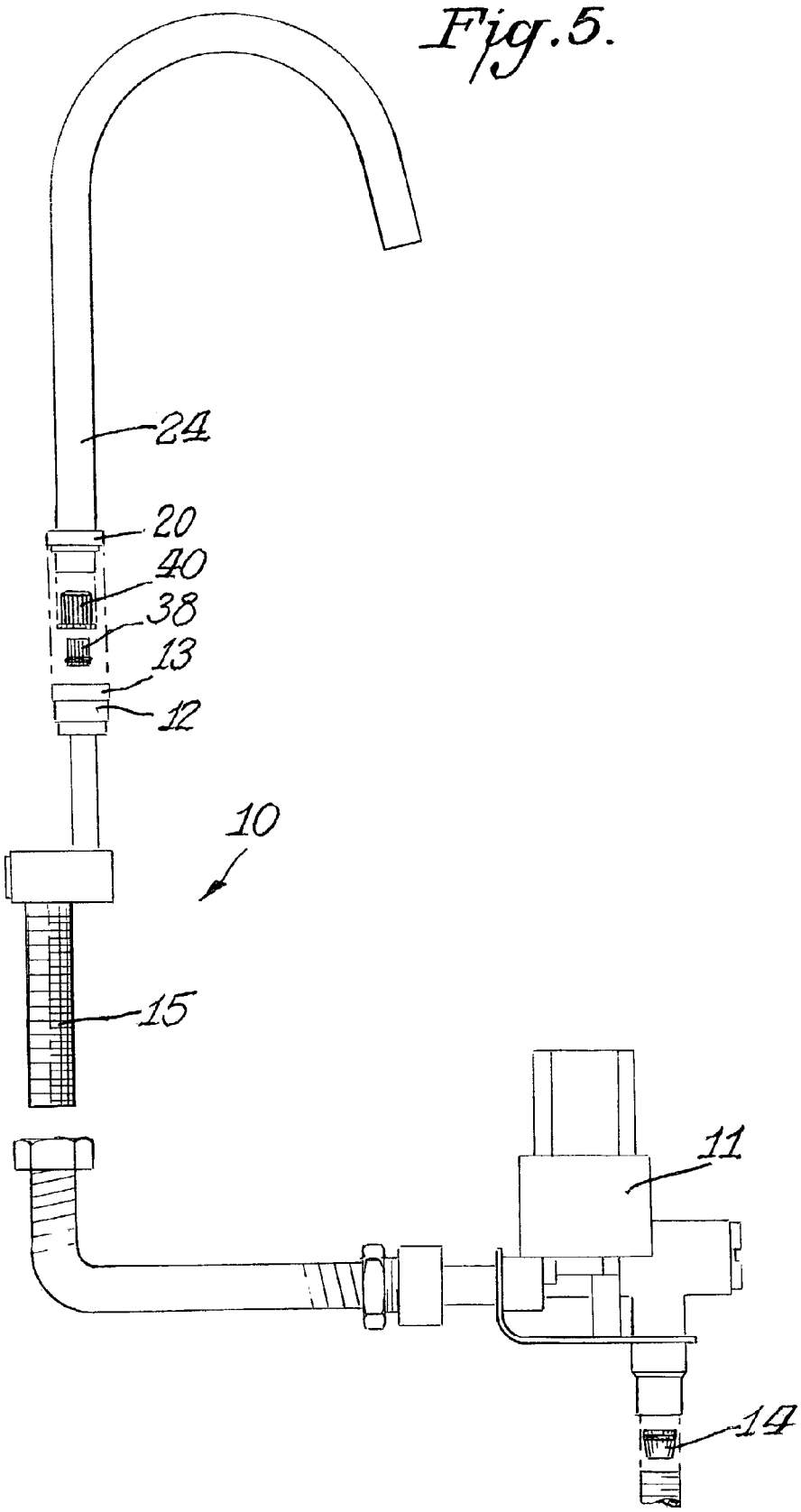
FIG. 5 is an exploded view of the faucet assembly, including spout, spout receptacle and solenoid valve with interconnecting piping.
Figure 7:
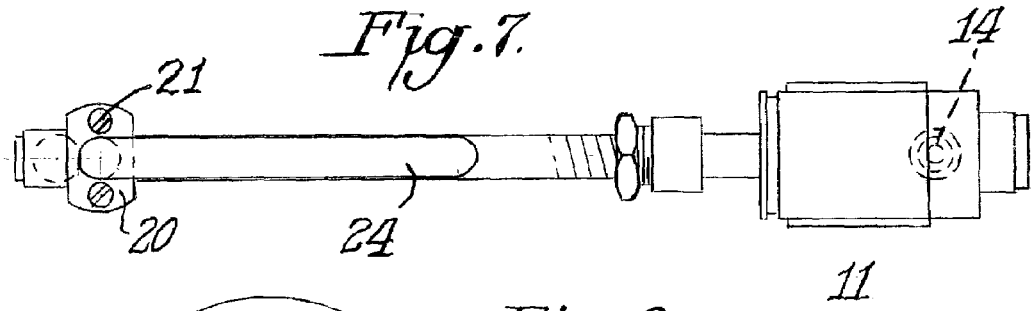
FIG. 7 is a top plan view of FIG. 6.
Figure 6:
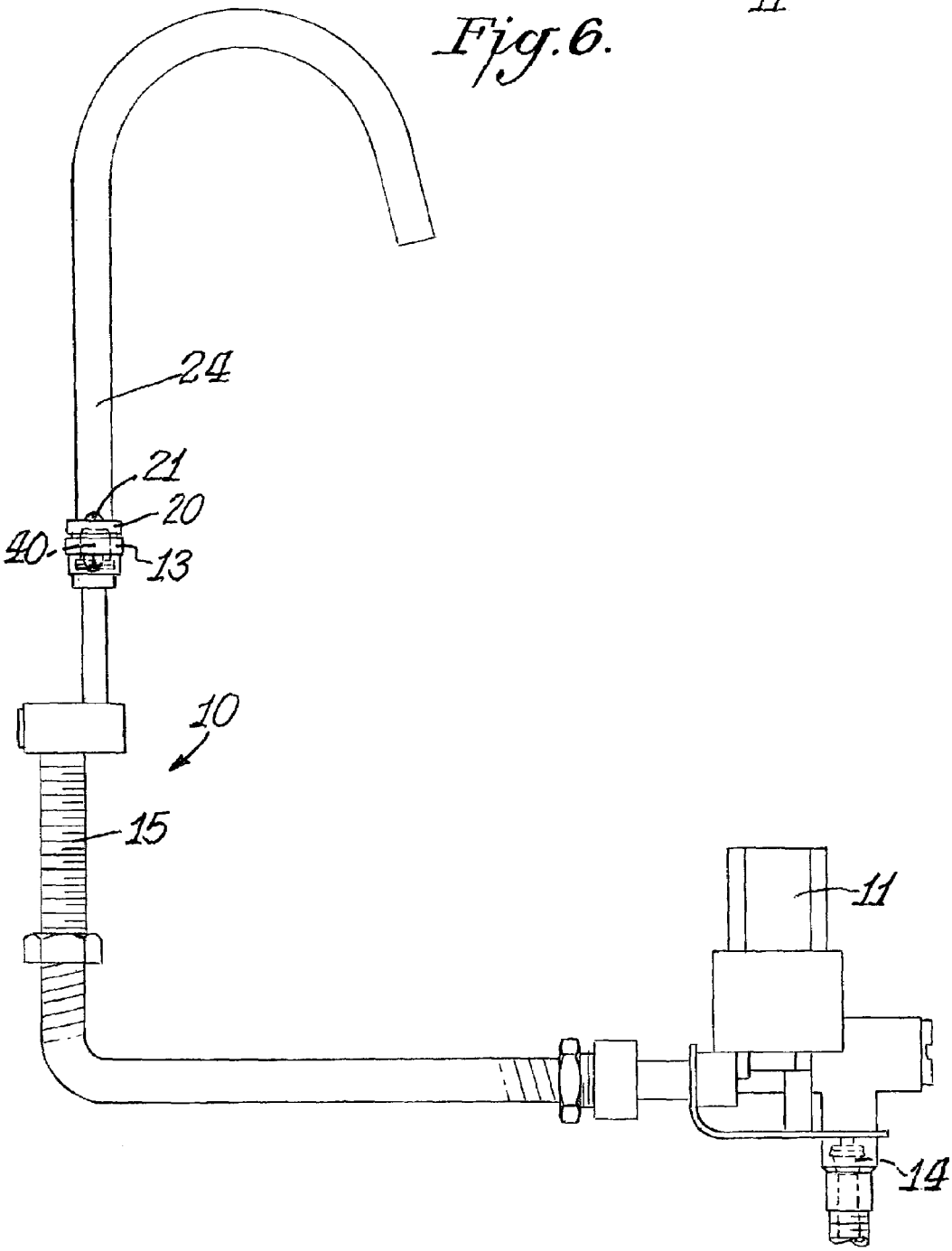
FIG. 6 is a side elevational view of the faucet assembly

Referring first to FIG. 5, the environment in which the invention is particularly useful is illustrated. The overall faucet spout assembly 10 of this invention is illustrated in this Figure. The faucet spout assembly 10 is connected to a water supply, not shown, through a solenoid valve 11 and interconnecting piping 15 although this illustrated piping is not essential to the operation of the faucet spout assembly. This piping 15 may be connected to a spout 24 by the means of a spout receptacle 12 with a flange 13 containing suitable openings therein for receipt of fasteners 21. The spout receptacle 12 or inlet to solenoid 11 may also contain a flow control device 14. The spout receptacle 12 may also contain sealing means such as a sealing washer 16 and/or sealing O-ring 18 therein (See FIG. 1). A flange 20 having axial opening 22 therein is adapted to fit over inlet end 24 of the spout 26 by brazing, solder or the like. The distance of the inlet end 24 of spout 26 extending beyond the bottom of flange 20 is dimensioned so that the inlet end 24 of the spout 26 will engage the upper surface of washer 16 in sealing engagement therewith. The flange 13 on the spout receptacle 12 and the spout flange 20 are held together by any means known in the art, for example, by bolts 21. Spouts A, B, and C, shown on the FIG. 1, are interchangeable in the spout assembly, though differ from each other by both height H (H1, H2, H3) and radius R (R1, R2, R3) of curvature.

Figure 2:
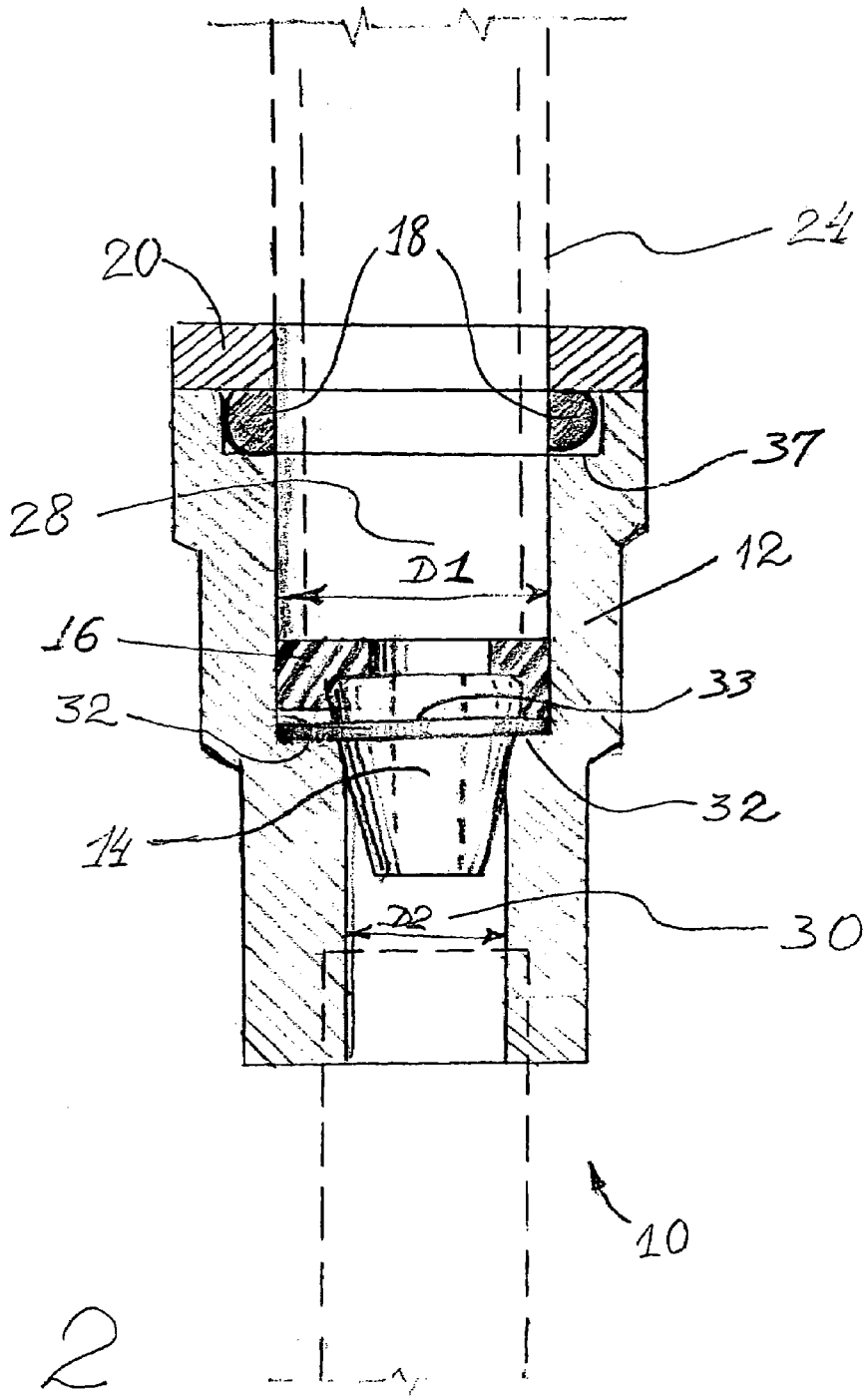
FIG. 2 is a sectional elevational view of the cup-like spout receptacle with the flow restrictor, sealing washer and sealing O-ring illustrated in the drawings and taken along a mid-line of all of them.

As is shown in FIG. 2, the spout receptacle 12 comprises two communicating portions: upper end 28 and lower end 30, wherein the upper end 28 has a greater diameter D1 than the diameter D2 of the lower end 30, so that the two portions form together a circular seat 32. As illustrated in these Figures, the seat 32 receives a flow control device 14, which is fixed in place by a snap ring 33. A sealing washer 16 is placed around the flow restrictor 14 at the bottom of the upper end 28 of spout receptacle 12. There is a circular recess 37 at the mouth of the upper end 28. O-ring 18 is placed in this recess 37.

Figure 3:
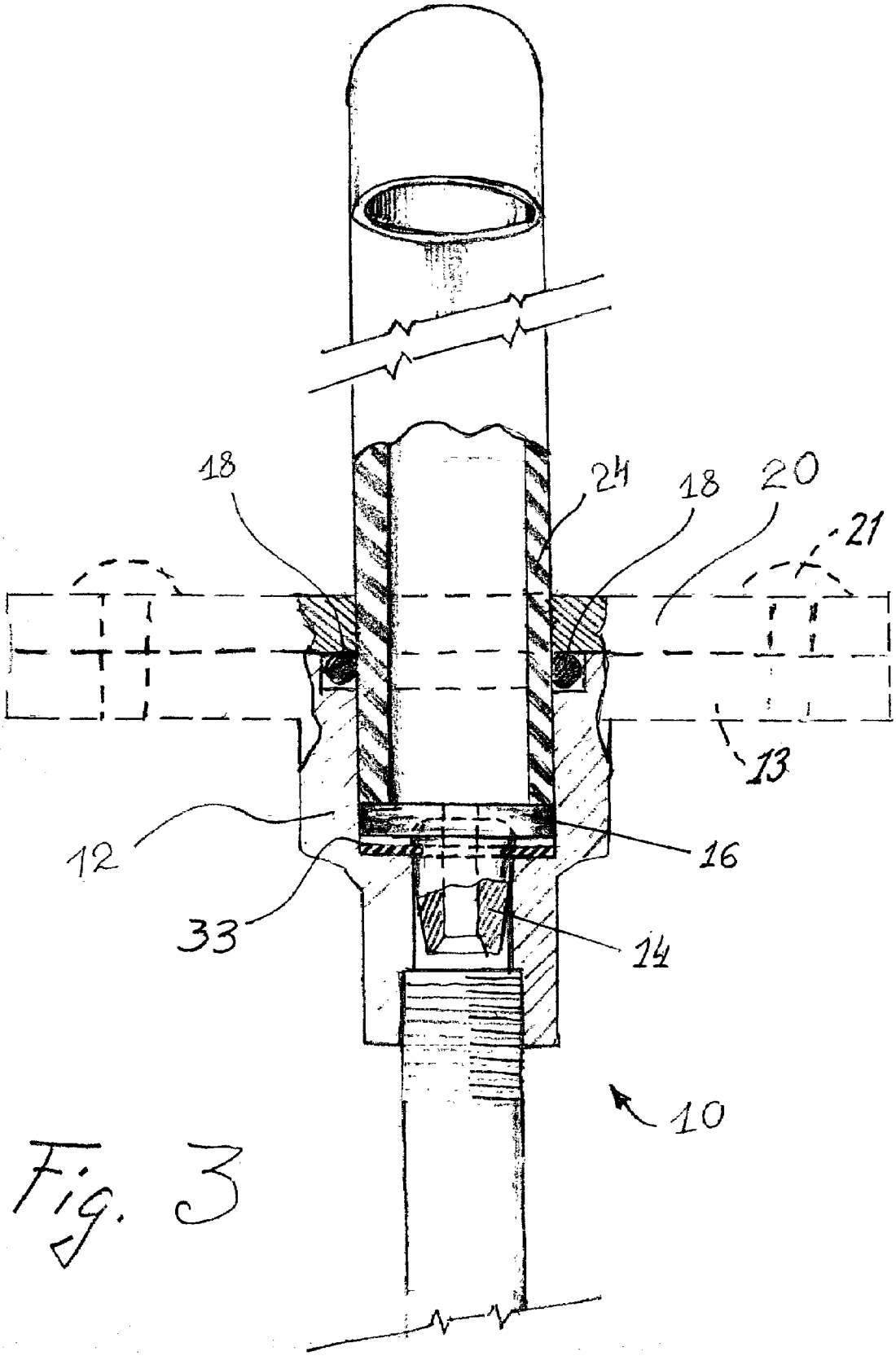
FIG. 3 is a front elevational view, partly in section, of the faucet spout assembly according to the present invention.
Figure 4:
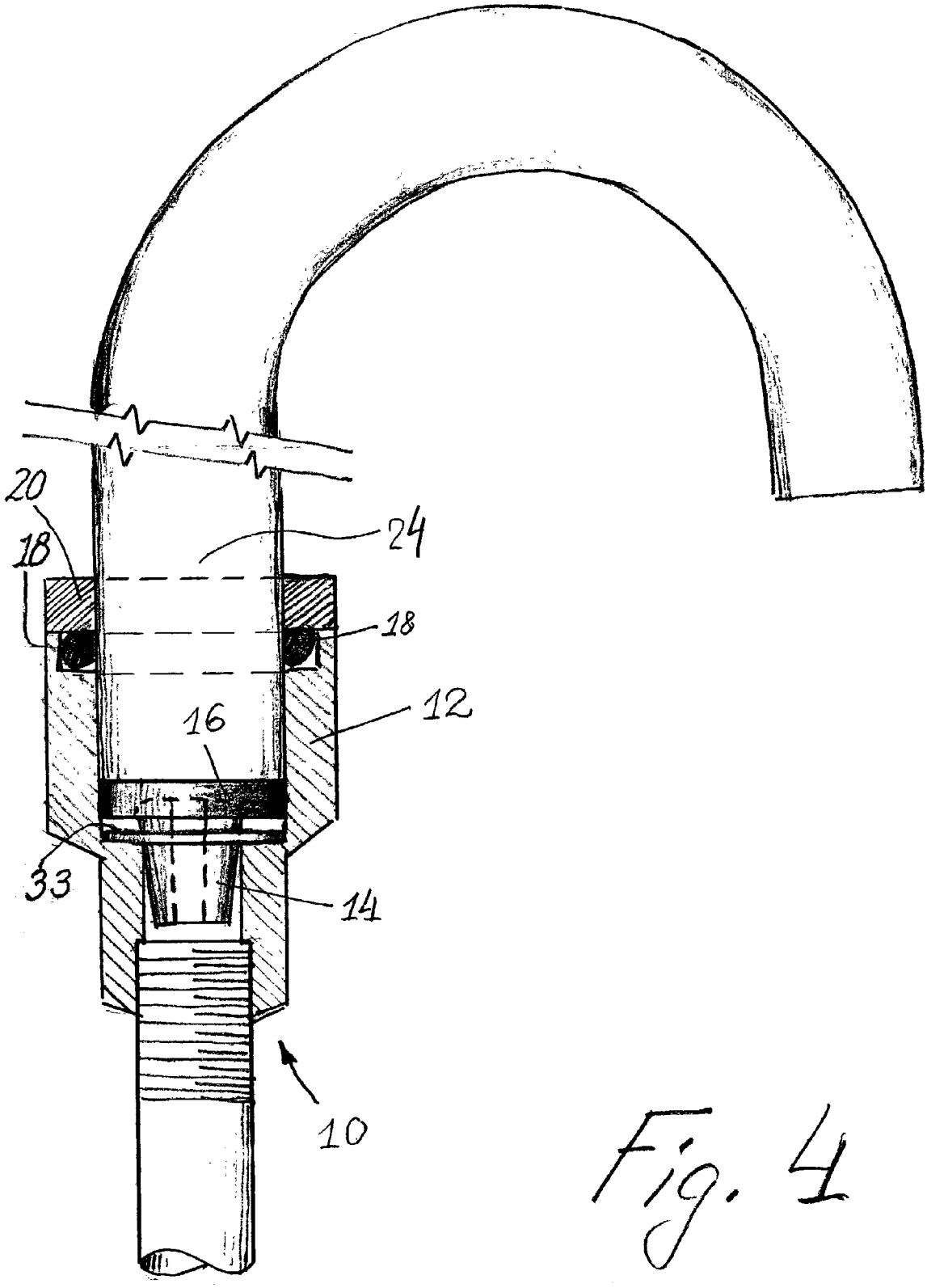
FIG. 4 is a partial side elevational view of faucet spout assembly according to the present invention.

Flange 20 on the inlet end 24 of spout 26 has openings aligned with like openings in spout receptacle 13 so that, upon tightening the bolts 21, or any other fasteners, the flanges are held together (FIG. 3). When so fastened, O-ring 18 is pressed between these flanges in recess 37 and the spout 26 is securely held in the faucet assembly. A double seal at this point is achieved when the bottom of spout 24 is sealingly engaged on washer 16. Any dimensional variance in placing flange 20 on spout 26 is accommodated by the compressibility of washer 16. Other spouts 26 can be easily substituted by simply undoing fasteners 21, lifting out one spout 26, replacing it with another and tightening fasteners 21.

Flow control device 14 is held in place on seat 32 of spout receptacle 12 by snap ring 33 which is press fit into the interior of spout receptacle 12. Water flowing through flow control device 14 assumes a soft, laminar flow as it exits the spout 26. It is believed that the soft, laminar flow is a result of maintaining a steady flow of water into the spout via the flow control device 14 in combination with the gooseneck shape of the spout 26.

In another embodiment of this invention illustrated in FIGS. 5–13, laminar flow from spout 26 is achieved even though the laminar flow control device 14 is far removed from the outlet of spout 26. In this embodiment, the interchangeability of spouts 26 is achieved using means described above. However, instead of placing a laminar flow control device 14 in spout receptacle 12, it is placed well upstream in the inlet to solenoid valve 11. Alternatively, flow control device 14 can be placed elsewhere in the piping 15 interconnecting the solenoid and spout receptacle 12. It has been found that the noise associated with operation of the faucet assembly 10 is lower when the flow control device 14 is placed in the solenoid 11 inlet versus in the spout receptacle 12.

A placement of the laminar flow control device 14 in the inlet of solenoid valve 14 is illustrated in FIGS. 5–6 and 12–14. In this embodiment, the flow control device 14 contains an inner passage 34 through which water passes on the way to spout 26. The interior walls of this passage are flexible and respond to varying water pressure in a manner that assures constant flow levels through the spout 26. An O-ring 36 on the exterior of flow control device 14 seals it within the inlet of solenoid 11.

This placement of the flow control device 14 in the faucet spout assembly 10 is facilitated by location of a check valve 38 in the inlet to spout 26. Unexpectedly, it has been found that the placement of the check valve 38 near the inlet to spout 26 traps a certain amount of water in the vertical portion 24 of spout 26 after each usage of the faucet spout assembly 10. This column of water promotes laminar flow out of the spout 26. While the exact mechanism of this laminar flow and its relationship to check valve 38 is not yet fully understood, the effect has been proven. Check valve 38 operates in a normal manner to prevent backflow of water through spout 26 to solenoid 11 and ultimately the water supply. The check valve thus prevents contamination of the water supply, as well as enhancing laminar flow. The check valve 38 has a spring biased closure 42 which seals opening 44 in check valve 38 when flow of water to spout 26 is halted by solenoid 11 (See FIG. 11).

Figure 8:
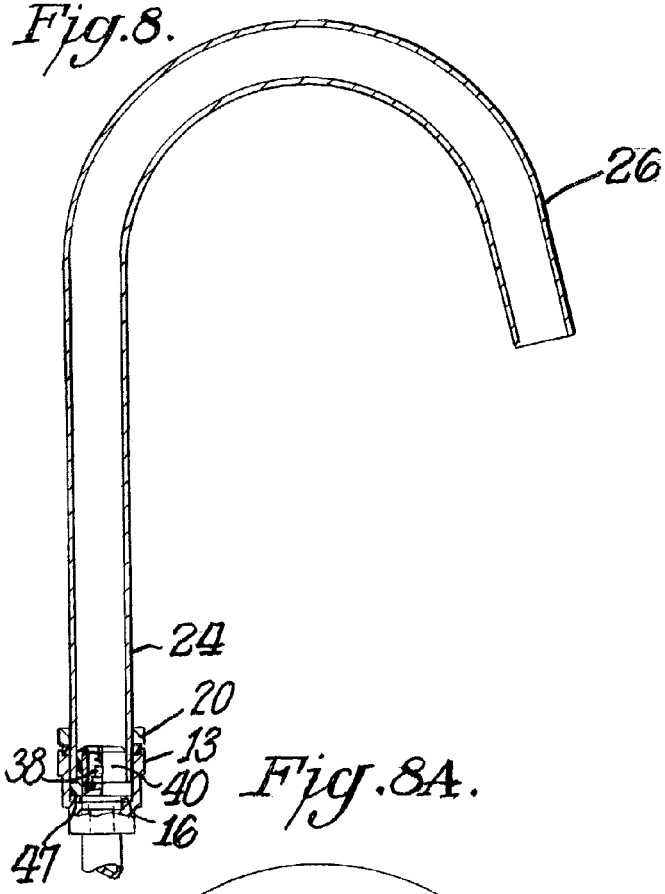
FIG. 8 is a cross-sectional, side elevational view of a faucet spout with a check valve and check valve holder arranged in the inlet of the spout

Check valve 38 is positioned in the inlet portion 24 of spout 26 within a check valve holder 40 as illustrated in FIG. 8. Check valve holder 40 is preferably cylindrical with an exterior dimension closely matching the interior dimension of spout 26. One end of the check valve holder 40 contains a rim 46 which increases the sealing area of the holder when placed into spout receptacle 12.

An arrangement of check valve holder 40 in spout receptacle 12 and its mating relationship with the lower end 24 of spout 26 is shown in FIG. 8 As illustrated, seat 32 receives washer 16 in a manner previously described The bottom surface 47 of the check valve holder is sealingly positioned on the upper surface of washer 16. It is pressed against washer 16 by the bottom edge of spout 26, pressing on the top of rim 46 as the flanges 20 and 13 on the spout 26 and spout receptacle 12, respectively, are secured to each other by fasteners 21 Additional sealing at this juncture is achieved by o-ring 18 interposed around the periphery of spout 26 and between the flanges 13 and 20.

Figure 8A:
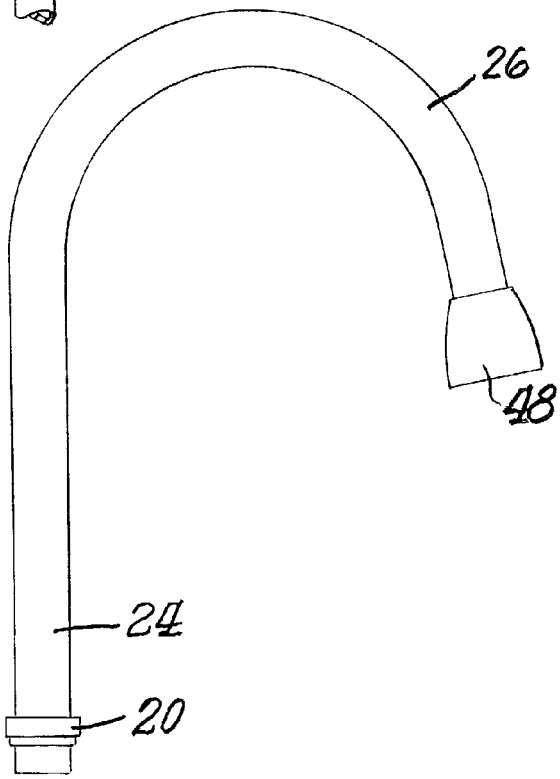
FIG. 8A is a fragmental side elevational view of a different shape of a gooseneck spout with an aerated outlet.
Figure 9:
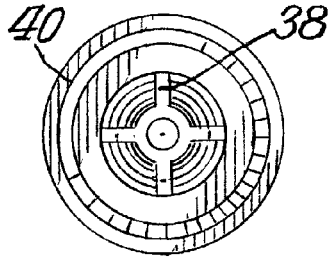
FIG. 9 is a top plan view of a check valve holder and check valve.
Figure 10:
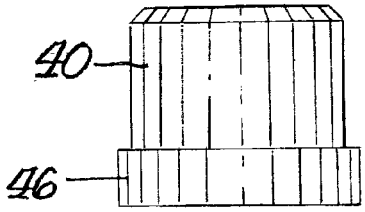
FIG. 10 is a side elevational view of the check valve holder
Figure 11:
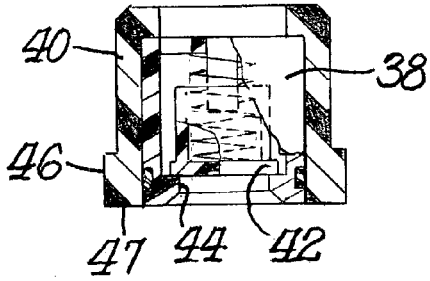
FIG. 11 is a cross-sectional view in elevation of the check valve holder with check valve shown in partial cross-section
Figure 12:
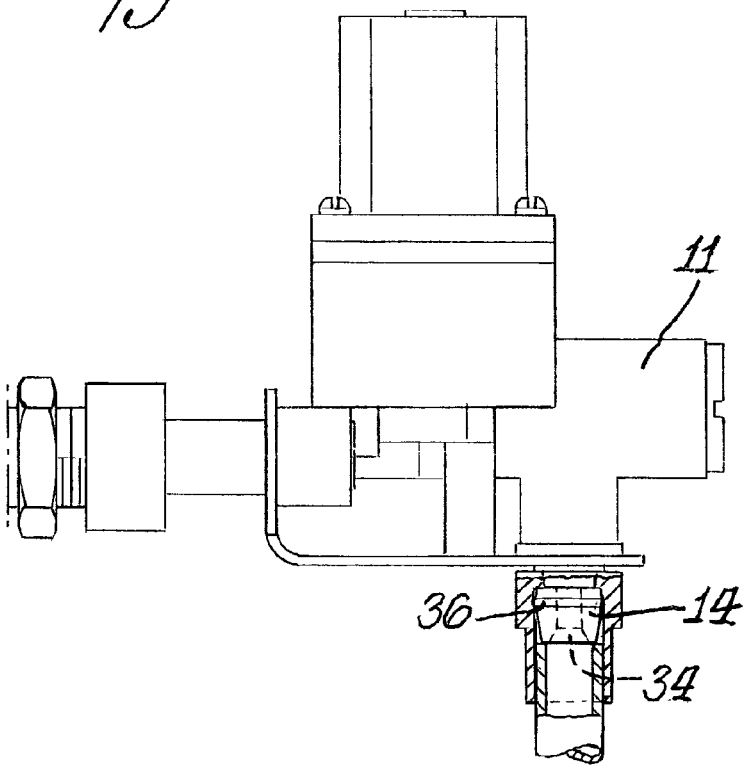
FIG. 12 is a side elevational view of a solenoid valve control for the faucet spout assembly showing a laminar flow control device in the inlet of the solenoid valve control.
Figure 14:
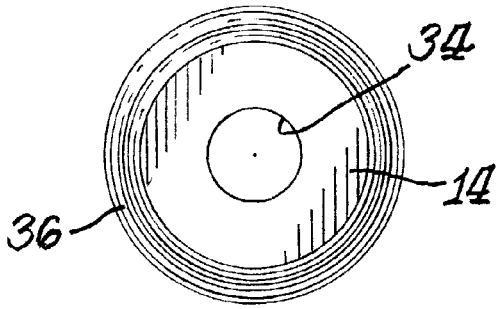
FIG. 14 is a top plan view of the flow control device
Figure 13:
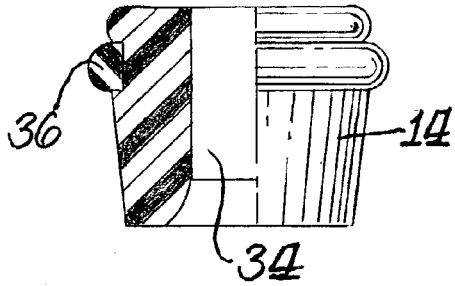
FIG. 13 is a side elevational view, partially broken away, showing a laminar flow control device.

Although the preferred means of achieving a non-splashing flow from spout 26 is use of a flow control device 14 as described above, other means such as an aerator 48 can be used to achieve this goal (See FIG. 8A). When an aerator is used on one of the interchangeable spouts, use of a check valve in the assembly is optional.

What is claimed is:

1. A faucet spout assembly useable with multiple interchangeable spouts of varying dimensions comprising a) a spout receptacle sealingly connectable to a fluid supply, said receptacle including a central passage for fluid flow at least one flange attached to the spout receptacle and having openings for receipt of a fastener, and at least one sealing means located in the central passage;

b) at least one spout capable of sealing engagement with the spout receptacle including a fluid conduit having a straight portion and u-shaped portion to form a gooseneck; a flange attached to the straight portion of the conduit and having openings in the flange therein aligned with the openings of the spout receptacle flange; and c) fasteners capable of passage through the openings in the flanges of the spout and spout receptacle to releasably attach the spout to the spout receptacle.

2. The faucet of claim 1, wherein the sealing means in the central passage of the spout receptacle is a washer.

3. The faucet of claim 1, wherein the sealing means in the central passage of the spout receptacle is an O-ring.

4. The faucet of claim 3 wherein the central passage of the spout receptacle includes a circular recess for receipt of the O-ring.

5. The faucet of claim 1 wherein the sealing means in the central passage of the spout receptacle includes a washer and O-ring.

6. The faucet of claim 5 wherein the central passage of the spout receptacle includes a circular seat for receipt of the washer.

7. The faucet of claim 6 wherein a bottom surface of the spout sealingly compresses the washer when fastened to the spout receptacle.

* * * * *